US007351943B1

(12) United States Patent
Kubler

(10) Patent No.: US 7,351,943 B1
(45) Date of Patent: Apr. 1, 2008

(54) AUTOMATED MICROWAVE TURNTABLE

(76) Inventor: Kenneth Kubler, 134 Walter Aven., Hasbrouck Heights, NJ (US) 07604

( * ) Notice: Subject to any disclaimer, the term of this patent is extended or adjusted under 35 U.S.C. 154(b) by 0 days.

(21) Appl. No.: 11/634,311

(22) Filed: Dec. 5, 2006

Related U.S. Application Data

(60) Provisional application No. 60/742,223, filed on Dec. 5, 2005.

(51) Int. Cl.
*H05B 6/78* (2006.01)
*F24C 7/02* (2006.01)

(52) U.S. Cl. ..... 219/754; 219/762; 219/518; 99/443 R; 108/20

(58) Field of Classification Search ..... 219/752–755, 219/762–763, 702, 518; 108/20, 139; 99/451, 99/325, 443 R
See application file for complete search history.

(56) References Cited

U.S. PATENT DOCUMENTS 4,254,319 A * 3/1981 Beh et al. ..... 219/755
5,558,799 A * 9/1996 Kang ..... 219/754

FOREIGN PATENT DOCUMENTS

JP 4-340023 * 11/1992 ..... 219/754

* cited by examiner

*Primary Examiner*—Philip H. Leung

(57) ABSTRACT

An automated microwave cooking device turntable assembly includes an anchor member nested to a bottom surface of a microwave cooking device and extending upwardly within a cavity thereof. A drive gear is journaled about the anchor member and rotatable along a counter clockwise direction, and a body is seated on the drive gear and coupled thereto. A mechanism rotates the drive gear such that the annular body terminates at a position that insures that an item placed on the body remains identically oriented at a beginning and an ending of the cooking time. The rotating mechanism includes a peg that protrudes upwardly from the drive gear and is positioned along an outer edge thereof. A motor is coupled to the drive gear, and a switch is coupled to the motor and a power supply source respectively. An actuating arm is coupled to the switch.

9 Claims, 6 Drawing Sheets

AUTOMATED MICROWAVE TURNTABLE

CROSS REFERENCE TO RELATED APPLICATIONS

This application claims the benefit of U.S. Provisional Application No. 60/742,223, filed Dec. 5, 2005, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to microwave turntables and, more particularly, to an independently actuated turntable assembly for use with a microwave cooking device having an access door provided with a planar front edge registered along a front face of the microwave.

2. Prior Art

Portable turntables for microwave ovens are known and are commonly available in consumer markets. Such devices typically comprise a stationary base, a rotatable platform mounted to the base, and a drive motor. An on/off switching mechanism is generally provided to control the rotational movement of the platform relative to the base. Achievement of a suitable on/off switch for microwave turntables has proven illusive. Such switching mechanisms must be convenient to operate, fail-safe, and compact in spatial dimension so as to fit within the smaller microwave oven cavities. Further, the switching mechanism must smoothly act to move the turntable in and out of its rotational mode of operation without requiring manual manipulation.

While the above switch mechanism works well, it has certain deficiencies which prevent it from achieving all of the above-discussed performance requirements. First, operation of a sliding switch is cumbersome and can result in the turntable being pushed or pulled in jarring fashion. Undesired spillage of food stuffs supported by the turntable can result. Further, sliding actuation can cause the tooth of the sliding mechanism to stub against the gear teeth along the rim flange. Overcoming the impasse would require manual jogging of the lock mechanism and/or the turntable platform. However, such a procedure in the small confines of a microwave oven is awkward and can, again, result in foodstuff spillage.

One prior art example shows a switch assembly for a microwave oven turntable that comprises a base and a platform rotatably mounted thereupon. The platform is adapted having a downward peripheral rim flange, along which an annular gear ring is provided. A flange extends outward from the base beyond and below the rim flange. A switch mechanism includes a rocker body pivotally mounted to the flange and adapted to pivot toward and away from the flange. A locking finger extends under the rim flange and upward into a parallel and adjacent relationship with the gear ring.

The locking finger is of triangular saw-toothed cross section defining an apex ridge oriented toward the gear ring. The gear teeth of the gear ring likewise have a saw-tooth configuration. Rocking actuation of the switch body causes the locking finger to pivot toward and away from meshing engagement with the gear ring. Unfortunately, this prior art example requires manual operation of the switch mechanism wherein such a mechanism can be broken or damaged, thus rendering the invention useless for its intended purpose. In addition, this example does not provide a means of automatically returning the turntable to its starting position when cooking operations are completed.

One prior art example shows a two level turntable adapted for use in a microwave oven. The top level platform which may include a roasting rack is removably supported above the bottom level by a plurality of columns. The bottom level platform has a shaft that extends downwardly through an aperture in a microwave shielding enclosure to a motor. The motor components consisting of a coil spring and a braking mechanism are mounted in substantially the same horizontal plane to provide a relatively low vertical profile.

Although the low profile is important when the bottom level platform is used by itself, it is even more important when the top level platform is mounted on top. The shielding enclosure which includes a pan shaped bottom has a downwardly bent lip from the lid to provide a low microwave field region adjacent to the connection of the pan and lid. Unfortunately, this prior art example is cumbersome and occupies a large amount of interior space of a microwave while in use. In addition, this example also does not provide a means of automatically returning the turntable to its starting position when cooking operations are completed.

Accordingly, a need remains for an automated microwave turntable in order to overcome the above-noted shortcomings. The present invention satisfies such a need by providing a device that is convenient and easy to use, is lightweight yet durable in design, and assists a user to prepare food in a microwave cooking device. Such a device conveniently offers an automatic reference point whereby an item placed on the turntable advantageously returns to the original starting point when cooking operations are complete. The device effectively eliminates the risk of burns to a user from manually turning a cup or tray around in order to remove it from the microwave, and thereby increases the safety of use for adults and children. The device is available for use in private homes as well as businesses and commercial entities. The present invention is inexpensive, simple to use, and designed for many years of repeated use.

BRIEF SUMMARY OF THE INVENTION

In view of the foregoing background, it is therefore an object of the present invention to provide an assembly for an automated microwave turntable. These and other objects, features, and advantages of the invention are provided by an independently actuated turntable assembly for use with a microwave cooking device having an access door provided with a planar front edge registered along a front face of the microwave.

The assembly includes an anchor member conveniently nested to a bottom surface of the microwave cooking device and extending upwardly within a cavity thereof. An annular drive gear is concentrically journaled about the anchor member and freely rotatable along a counter clockwise direction, and an annular body is directly seated on the drive gear and statically coupled thereto. Such a body is disposed at an initial position prior to operating conditions, and the drive gear and the body advantageously rotate in sync.

The drive gear includes a corrugated outer perimeter conveniently provided with a plurality of equidistantly juxtaposed teeth effectively disposed along an entire circumference of the drive gear. The motor (herein described below) includes a worm gear directly driven thereby. Such a worm gear is directly mated with the outer perimeter of the drive gear such that the drive gear advantageously rotates along the counter clockwise direction when the worm gear rotates along a rotational path effectively defined about a fulcrum axis registered parallel to the access door when the access door is adapted to the closed position.

The assembly further includes a mechanism for independently rotating the drive gear after a cooking time of the microwave cooking device has lapsed such that the annular body effectively terminates at a position identical to the initial position and thereby advantageously insures that an item placed on the body conveniently remains identically oriented at a beginning and an ending of the cooking time.

The drive gear rotating mechanism includes a linear peg that protrudes upwardly from a top surface of the drive gear and is positioned along an outer edge thereof. The rotating mechanism further includes a motor operably coupled to the drive gear, and a switch electrically coupled to the motor and a power supply source respectively. A linear actuating arm is operably coupled to the switch in such a manner that the arm effectively intersects a travel path of the peg. Such a peg biases the arm to a lower position when the drive gear completes a full revolution about the anchor member. Such a biased arm toggles the switch to an open position and thereby advantageously interrupts power to the motor such that the drive gear effectively stops rotating when the peg is centrally aligned with the access door.

The drive gear rotating mechanism further includes a mobile first sensor mounted to the drive gear and effectively traveling along the counter clockwise direction during the cooking time, and a second sensor directly and statically coupled to the access door and medially positioned along a lateral width thereof. Such a second sensor is advantageously disposed at a fixed position effectively defining the initial and terminal positions respectively. The first and second sensors are aligned when the initial and terminal positions of the body are aligned.

A motor is directly connected to the drive gear, and a switch is electrically coupled to the motor. A logic gate is electrically coupled to the first and second sensors and the switch respectively. The first and second sensors effectively generate and transmit respective input signals to the logic gate when the first and second sensors become aligned. Such a logic gate interprets the input signals and transmits an output signal to the switch that toggles the switch to an open position and thereby effectively interrupts power to the motor such that the drive gear and the body conveniently stop at the initial position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
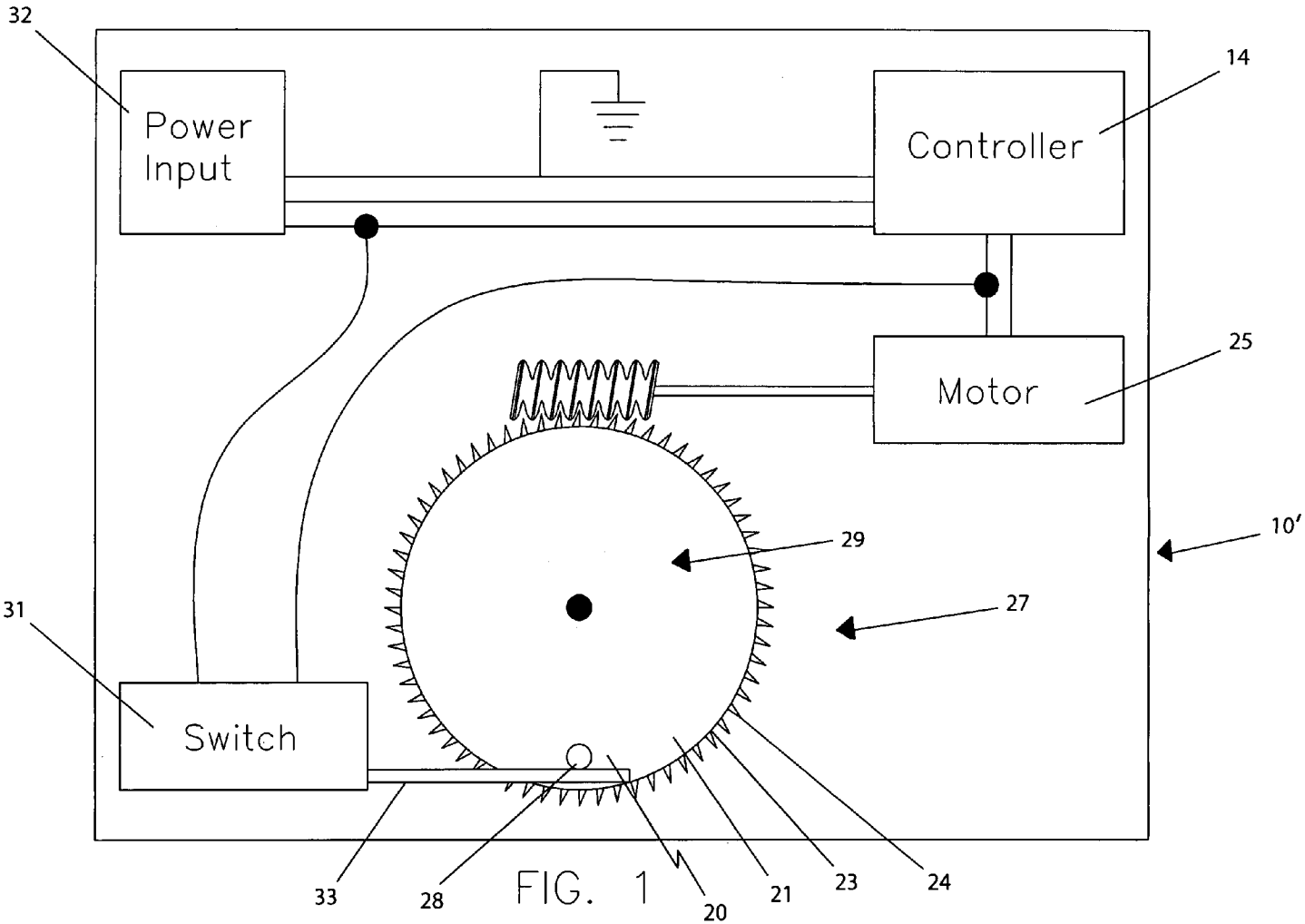
FIG. 1 is a top plan view showing an automated microwave cooking device turntable in the beginning or ending position, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-6 by the reference numeral 10 and 10' is intended to provide an automated microwave cooking device turntable. It should be understood that the assembly 10 and 10' may be used as an automated turntable with many different types of devices and should not be limited in use to providing an automated turntable only for those types of devices described herein.

Referring initially to FIGS. 1, 2, 3, and 5, the assembly 10 includes an anchor member 20 nested to a bottom surface 11 of the microwave cooking device 12 and extending upwardly within a cavity 13 thereof. An annular drive gear 21 is concentrically journaled about the anchor member 20 and freely rotatable along a counter clockwise direction, and an annular body 22 is directly seated on the drive gear 21 and statically coupled thereto, without the use of intervening elements. Such a body 22 is disposed at an initial position prior to operating conditions, and the drive gear 21 and the body 22 advantageously rotate in sync. Such synchronous rotation is essential such that a force applied to the drive gear 21 is transferred to the body 22 during operating conditions, thereby moving the body 22 and an object placed thereon as intended by the invention.

Referring to FIGS. 1, 2, 3, 4 and 5, the drive gear 21 includes a corrugated outer perimeter 23 provided with a plurality of equidistantly juxtaposed teeth 24 disposed along an entire circumference of the drive gear 21. The motor 25 (herein described below) includes a worm gear 26 directly driven thereby, without the use of intervening elements. Such a worm gear 26 is directly mated with the outer perimeter 23 of the drive gear 21, without the use of intervening elements, which is essential such that the drive gear 21 advantageously rotates along the counter clockwise direction when the worm gear 26 rotates along a rotational path defined about a fulcrum axis registered parallel to the access door 15 when the access door 15 is adapted to the closed position. Such a direct mating of the worm gear 26 and the drive gear 21 provides an efficient means of rotating the body 22 without any loss of conventional gear or drive ratios during operating conditions.

Again referring to FIGS. 1, 2, 3 and 5, the assembly 10 further includes a mechanism 27 for independently rotating the drive gear 21 after a cooking time of the microwave cooking device 12 has lapsed, which is critical such that the body 22 terminates at a position identical to the initial position and thereby advantageously insures that an item placed on the body 22 remains identically oriented at a beginning and an ending of the cooking time. Such a mechanism 27 provides independent rotation to the body 22, which is essential such that the body 22 continues rotating to the terminal, position after cooking procedures have ceased.

Figure 2:
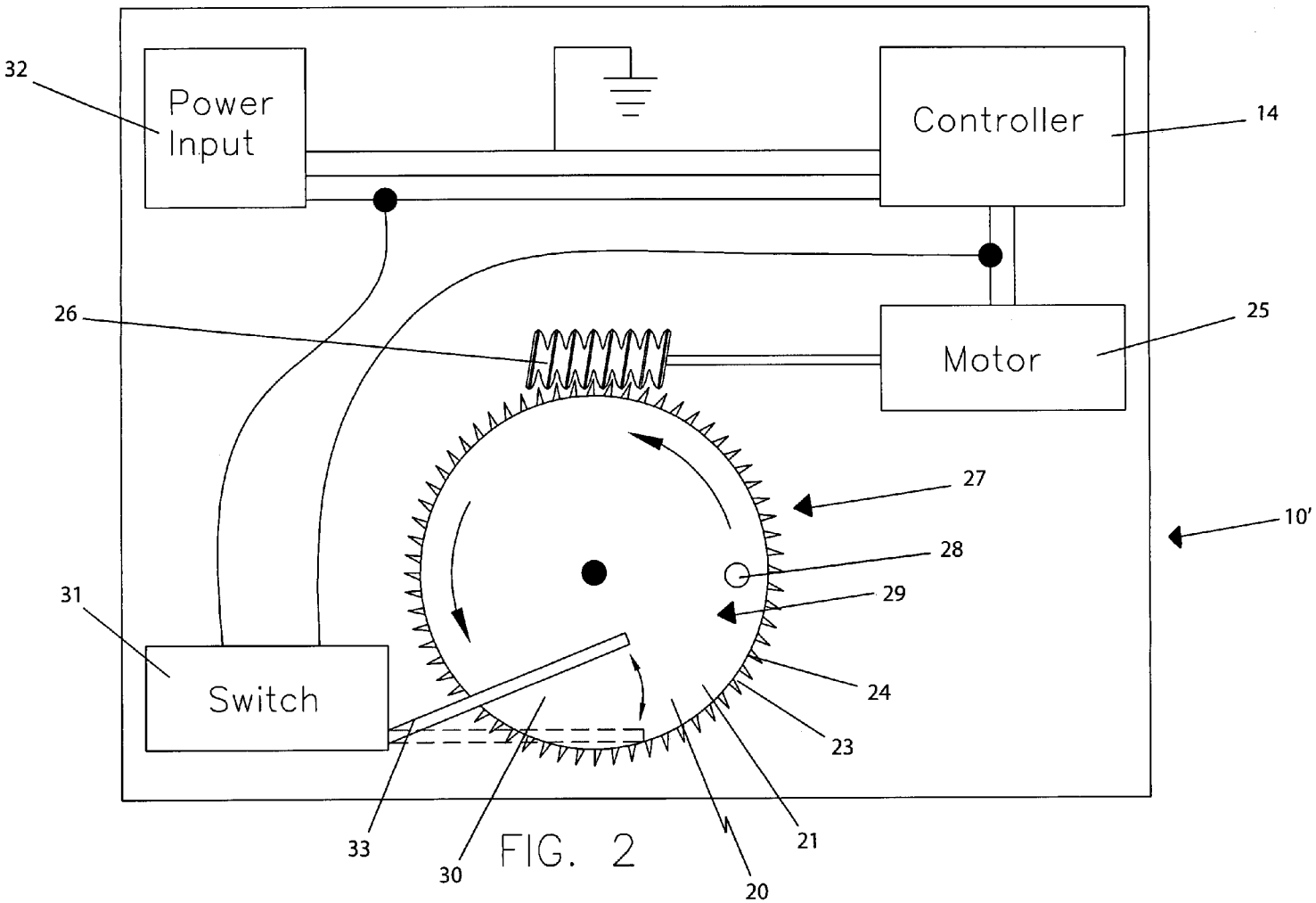
FIG. 2 is a top plan view of the assembly shown in FIG. 1 showing the assembly in a position between beginning and ending positions.
Figure 3:
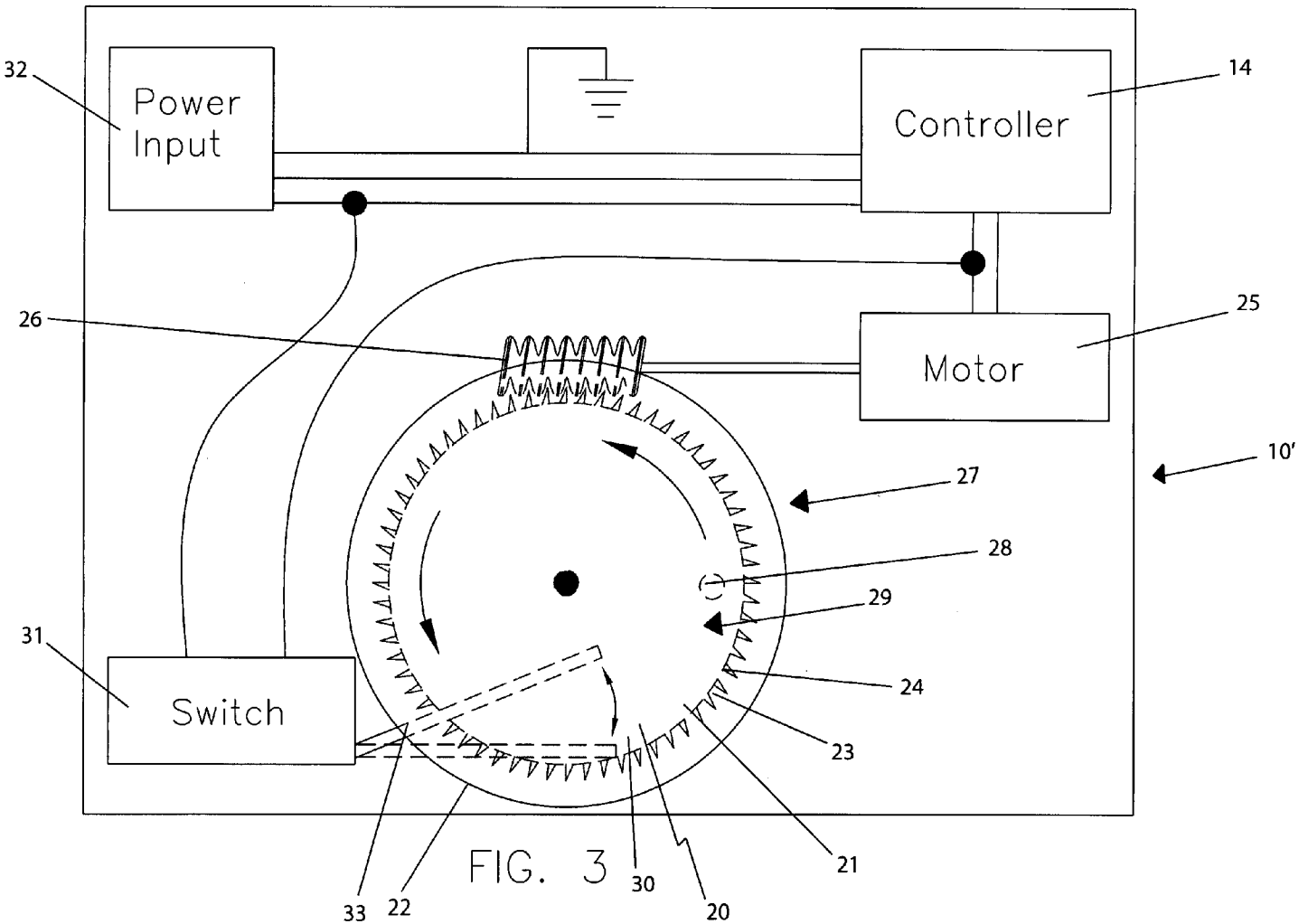
FIG. 3 is a top plan view of the assembly shown in FIG. 2 showing the annular body seated on the anchor member.
Figure 4:
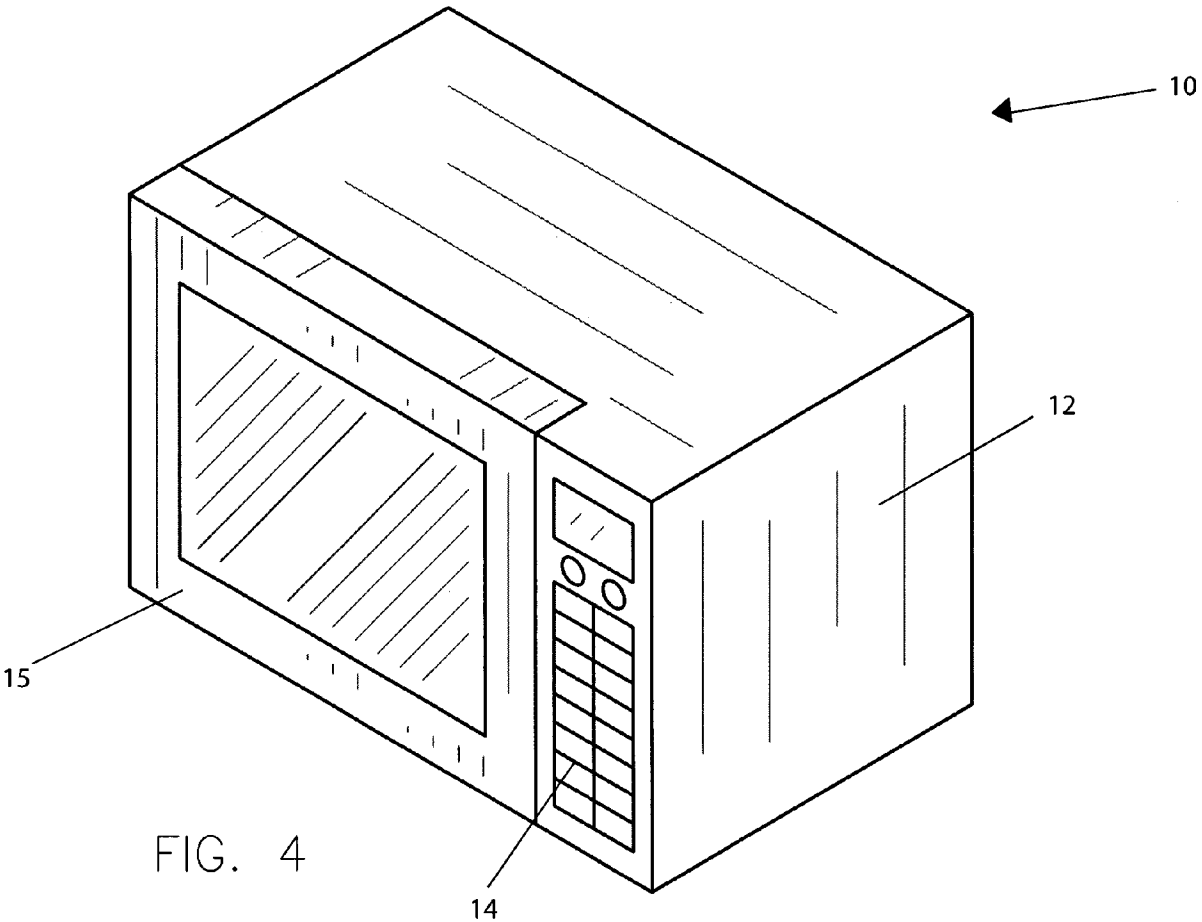
FIG. 4 is a perspective view of a microwave cooking device having an access door provided with a planar front edge registered along a front face of the microwave cooking device and suitable for use with the present invention.
Figure 5:
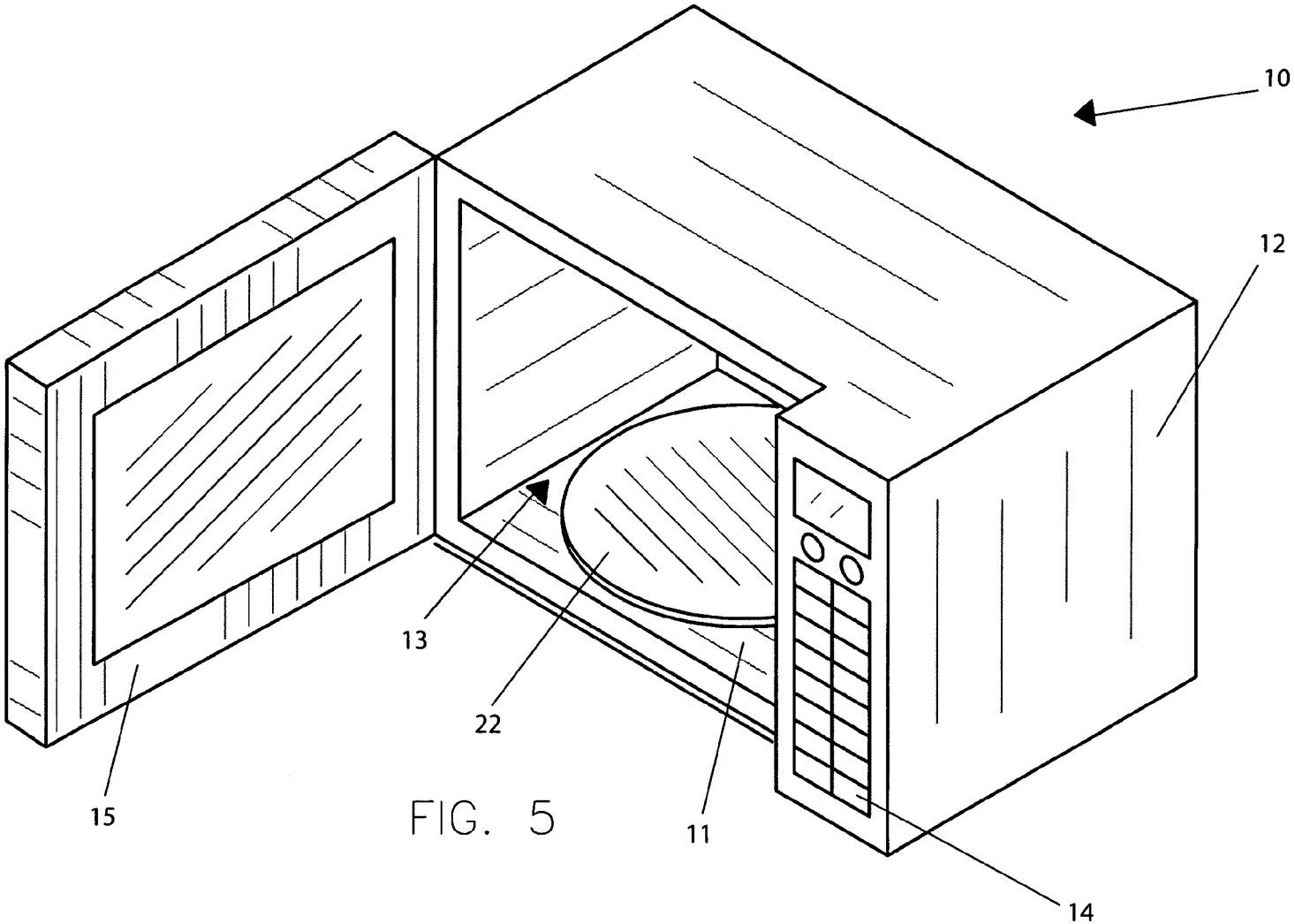
FIG. 5 is a perspective view of the device shown in FIG. 4 showing the invention nested therein.

Referring to FIGS. 1, 2 and 3, in an alternate embodiment 10', the drive gear rotating mechanism 27 includes a linear peg 28 that protrudes upwardly from a top surface 29 of the drive gear 21 and is positioned along an outer edge 30 thereof. The rotating mechanism 27 further includes a motor 25 operably coupled to the drive gear 21, and a switch (herein described below) 31 electrically coupled to the motor 25 and a power supply source 32 respectively.

A linear actuating arm 33 is operably coupled to the switch 31, which is crucial such that the arm 33 intersects a travel path of the peg 28. Such a peg 28 biases the arm 33 to a lower position when the drive gear 21 completes a full revolution about the anchor member 20. Such a biased arm 33 toggles the switch 31 to an open position and thereby advantageously interrupts power to the motor 25, which is vital such that the drive gear 21 stops rotating when the peg 28 is centrally aligned with the access door 15. When the power is interrupted to the motor 25, the body 22 is stopped at the terminal position, and the user can safely access the interior of the microwave cooking device 12 and retrieve the object therefrom.

Figure 6:
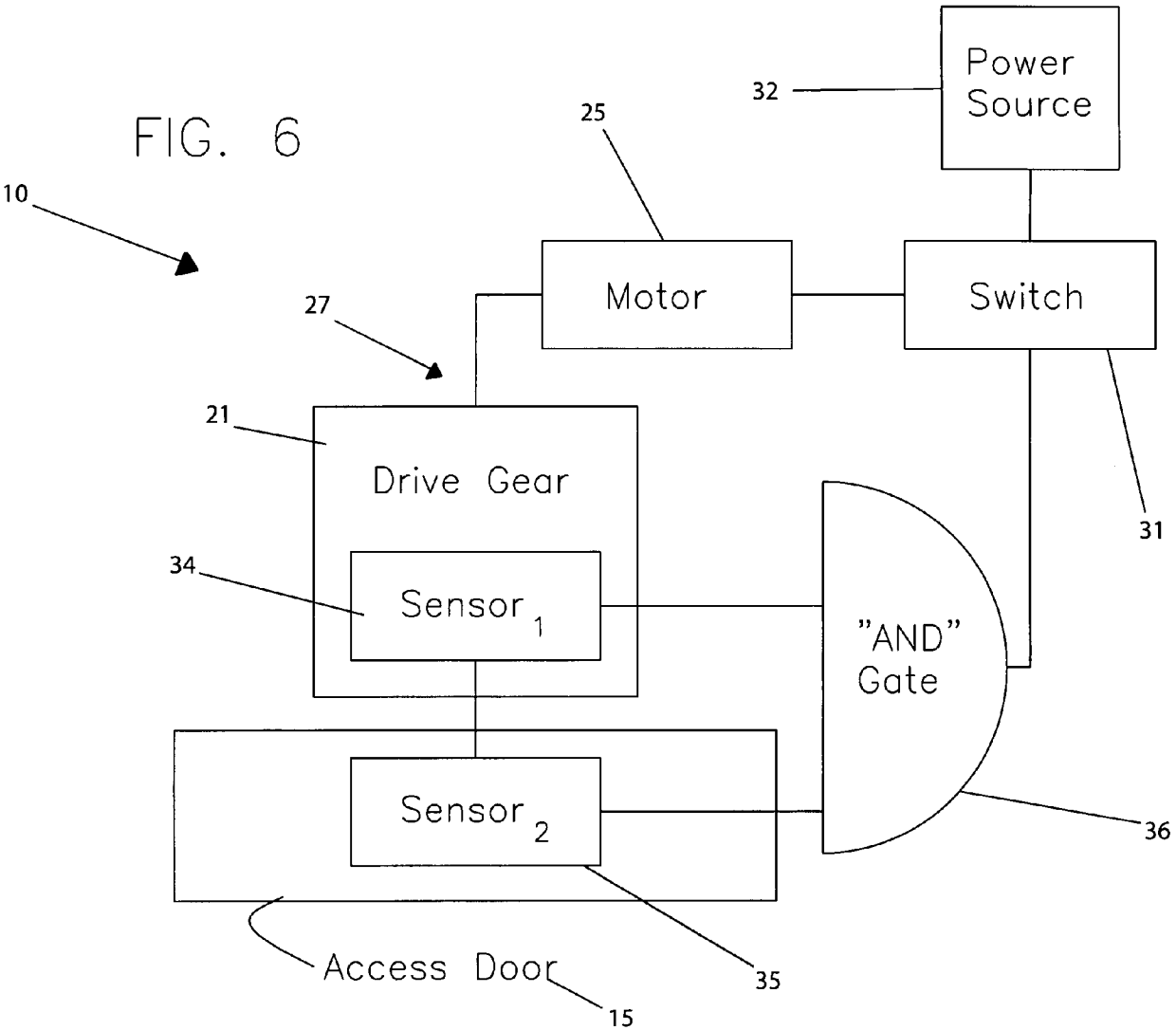
FIG. 6 is a schematic block diagram of the assembly shown in FIG. 1.

Referring to FIG. 6, in a preferred embodiment 10, the drive gear rotating mechanism 27 further includes a mobile first sensor 34 mounted to the drive gear 21 and traveling along the counter clockwise direction during the cooking time, and a second sensor 35 directly and statically coupled to the access door 15, without the use of intervening elements, and medially positioned along a lateral width thereof. Such a second sensor 35 is advantageously disposed at a fixed position defining the initial and terminal positions respectively. The first and second sensors 34, 35 are aligned when the initial and terminal positions of the body 22 are aligned, and thereby stop the rotational motion of the body 22 at alignment.

Again referring to FIG. 6, a motor 25 is directly connected to the drive gear 21, without the use of intervening elements, and a switch 31 is electrically coupled to the motor 25. A logic gate 36 is electrically coupled to the first and second sensors 34, 35 and the switch 31 respectively, and in this particular instance the logic gate is an AND gate 36. The first and second sensors 34, 35 generate and transmit respective input signals to the logic gate 36 when the first and second sensors 34, 35 become aligned. Such a logic gate 36 interprets the input signals and transmits an output signal to the switch 31 that toggles the switch 31 to an open position and thereby interrupts power to the motor 25, which is necessary such that the drive gear 21 and the body 22 stop at the initial position. The controller 14 of the microwave cooking device 12 is electrically coupled to the motor 25 in such a manner that a user can input a command thereto that Instructs the motor 25 to operate the worm gear 26, thus turning the anchor member 20, as desired.

The ability of the present invention to return an object placed on the body 22 to its original pre-cooking position provides the unexpected benefit of allowing a user to remove the object without having to turn the object first. This benefit reduces the chance of a user being burned by an object or its contents, thereby overcoming prior art shortcomings and making the assembly 10 safer to use by children and adults.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An independently actuated turntable assembly for use with a microwave cooking device having an access door provided with a planar front edge registered along a front face of the microwave cooking device, said turntable assembly comprising:

an anchor member nested to a bottom surface of the microwave cooking device and extending upwardly within a cavity thereof;

an annular drive gear concentrically journaled about said anchor member and freely rotatable along a counter clockwise direction;

an annular body directly seated on said drive gear and statically coupled thereto, said body being disposed at an initial position prior to operating conditions;

means for independently rotating said drive gear after a cooking time of the microwave cooking device has lapsed such that said annular body terminates at a position identical to said initial position and thereby insuring that an item placed on said body remains identically oriented at a beginning and an ending of the cooking time;

wherein said drive gear rotating means comprises a mobile first sensor mounted to said drive gear and traveling along the counter clockwise direction during the cooking time;

a second sensor directly and statically coupled to the access door and medially positioned along a lateral width thereof, said second sensor being disposed at a fixed position defining said initial and terminal positions respectively;

a motor directly connected to said drive gear;

a switch electrically coupled to said motor respectively; and a logic gate electrically coupled to said first and second sensors and said switch respectively;

wherein said first and second sensors generate and transmit respective input signals to said logic gate when said first and second sensors become aligned, said logic gate interpreting said input signals and transmitting an output signal to said switch that toggles said switch to an open position and thereby interrupts power to said motor such that said drive gear and said body stop at the initial position.

2. The turntable assembly of claim 1, wherein said first and second sensors are aligned when the initial and terminal positions of said body are aligned.

3. The turntable assembly of claim 1, wherein said drive gear includes a corrugated outer perimeter provided with a plurality of equidistantly juxtaposed teeth disposed along an entire circumference of said drive gear, said motor including a worm gear directly driven thereby, said worm gear being directly mated with said outer perimeter of said drive gear such that said drive gear rotates along the counter clockwise direction when said worm gear rotates along a rotational path defined about a fulcrum axis registered parallel to said access door when said access door is adapted to the closed position.

4. An independently actuated turntable assembly for use with a microwave cooking device having an access door provided with a planar front edge registered along a front face of the microwave cooking device, said turntable assembly comprising:

an anchor member nested to a bottom surface of the microwave cooking device and extending upwardly within a cavity thereof;

an annular drive gear concentrically journaled about said anchor member and freely rotatable along a counter clockwise direction;

an annular body directly seated on said drive gear and statically coupled thereto, said body being disposed at an initial position prior to operating conditions, wherein said drive gear and said body rotate in sync;

means for independently rotating said drive gear after a cooking time of the microwave cooking device has lapsed such that said annular body terminates at a position identical to said initial position and thereby insuring that an item placed on said body remains identically oriented at a beginning and an ending of the cooking time;

wherein said drive gear rotating means comprises a mobile first sensor mounted to said drive gear and traveling alone the counter clockwise direction during the cooking time;

a second sensor directly and statically coupled to the access door and medially positioned along a lateral width thereof, said second sensor being disposed at a fixed position defining said initial and terminal positions respectively;

a motor directly connected to said drive gear;

a switch electrically coupled to said motor respectively; and a logic gate electrically coupled to said first and second sensors and said switch respectively;

wherein said first and second sensors generate and transmit respective input signals to said logic gate when said first and second sensors become aligned, said logic gate interpreting said input signals and transmitting an output signal to said switch that toggles said switch to an open position and thereby interrupts power to said motor such that said drive near and said body stop at the initial position.

5. The turntable assembly of claim 4, wherein said first and second sensors are aligned when the initial and terminal positions of said body are aligned.

6. The turntable assembly of claim 4, wherein said drive gear includes a corrugated outer perimeter provided with a plurality of equidistantly juxtaposed teeth disposed along an entire circumference of said drive gear, said motor including a worm gear directly driven thereby, said worm gear being directly mated with said outer perimeter of said drive gear such that said drive gear rotates along the counter clockwise direction when said worm gear rotates along a rotational path defined about a fulcrum axis registered parallel to said access door when said access door is adapted to the closed position.

7. An independently actuated turntable assembly for use with a microwave cooking device having an access door provided with a planar front edge registered along a front face of the microwave cooking device, said turntable assembly comprising:

an anchor member nested to a bottom surface of the microwave cooking device and extending upwardly within a cavity thereof;

an annular drive gear concentrically journaled about said anchor member and freely rotatable along a counter clockwise direction;

an annular body directly seated on said drive gear and statically coupled thereto, said body being disposed at an initial position prior to operating conditions, wherein said drive gear and said body rotate in sync;

means for independently rotating said drive gear after a cooking time of the microwave cooking device has lapsed such that said annular body terminates at a position identical to said initial position and thereby insuring that an item placed on said body remains identically oriented at a beginning and an ending of the cooking time;

wherein said drive gear rotating means comprises a linear peg protruding upwardly from a top surface of said drive gear and positioned along an outer edge thereof;

a motor operably coupled to said drive gear;

a switch electrically coupled to said motor and a power supply source respectively; and a linear actuating arm operably coupled to said switch in such a manner that said arm intersects a travel path of said peg;

wherein said peg biases said arm to a lower position when said drive gear completes a full revolution about said anchor member, said biased arm toggling said switch to an open position and thereby interrupting power to said motor such that said drive gear stops rotating when said peg is centrally aligned with said access door;

wherein said drive gear rotating means comprises a mobile first sensor mounted to said drive gear and traveling along the counter clockwise direction during the cooking time;

a second sensor directly and statically coupled to the access door and medially positioned along a lateral width thereof, said second sensor being disposed at a fixed position defining said initial and terminal positions respectively;

a motor directly connected to said drive gear;

a switch electrically coupled to said motor respectively; and a logic gate electrically coupled to said first and second sensors and said switch respectively;

wherein said first and second sensors generate and transmit respective input signals to said logic gate when said first and second sensors become aligned, said logic gate interpreting said input signals and transmitting an output signal to said switch that toggles said switch to an open position and thereby interrupts power to said motor such that said drive gear and said body stop at the initial position.

8. The turntable assembly of claim 7, wherein said first and second sensors are aligned when the initial and terminal positions of said body are aligned.

9. The turntable assembly of claim 7, wherein said drive gear includes a corrugated outer perimeter provided with a plurality of equidistantly juxtaposed teeth disposed along an entire circumference of said drive gear, said motor including a worm gear directly driven thereby, said worm gear being directly mated with said outer perimeter of said drive gear such that said drive gear rotates along the counter clockwise direction when said worm gear rotates along a rotational path defined about a fulcrum axis registered parallel to said access door when said access door is adapted to the closed position.

* * * * *